US006659627B2

(12) United States Patent
Caluori

(10) Patent No.: US 6,659,627 B2
(45) Date of Patent: Dec. 9, 2003

(54) LIGHT FIXTURE ASSEMBLY

(75) Inventor: Giuseppe Caluori, Dollard-des-Ormeaux (CA)

(73) Assignee: Canlyte Inc., Quebec (CA)

( * ) Notice: Subject to any disclaimer, the term of this patent is extended or adjusted under 35 U.S.C. 154(b) by 0 days.

(21) Appl. No.: 10/085,961

(22) Filed: Feb. 28, 2002

(65) Prior Publication Data

US 2003/0161155 A1 Aug. 28, 2003

(51) Int. Cl.[7] ..... F21V 15/00
(52) U.S. Cl. ..... 362/365; 362/364; 362/370
(58) Field of Search ..... 362/364, 365, 362/368, 370, 404

(56) References Cited

U.S. PATENT DOCUMENTS 5,957,574 A * 9/1999 Hentz et al. ..... 362/365

* cited by examiner

*Primary Examiner*—Sandra O'Shea
*Assistant Examiner*—Guiyoung Lee
(74) *Attorney, Agent, or Firm*—Jeffrey A. Haeberlin; Middleton Reutlinger

(57) ABSTRACT

A light fixture assembly is provided with a lamp housing having a top, a lamp socket within the lamp housing, a power pack operatively connected to the lamp socket, and a means for supported attachment of the power pack to the lamp housing at a position substantially lateral to the lamp housing, and not extending substantially above a plane defined by the top of the lamp housing. The power pack comprises a junction box containing a transformer operatively connected to the lamp socket, and means for operative attachment of the power pack to an electrical source. The means for supported attachment of the power pack to the lamp housing permits flexion of the junction box relative to the lamp housing.

22 Claims, 2 Drawing Sheets

LIGHT FIXTURE ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention relates to junction boxes, power packs and transformers for ceiling mounted light fixtures.

BACKGROUND OF THE INVENTION

Ceiling mounted lights such as pot lights are typically constructed with the light bulb housed within a substantially cylindrical lamp housing. A transformer and an electrical junction box for connection to an electrical source are mounted on the lamp housing. Conventional ceiling mounted light fixtures are typically constructed in a linear format, such as the transformer and junction box stacked upon the lamp housing. A conventional light fixture assembly having this stacked configuration is typically greater than 6 inches in height.

In older buildings, 8 inch by 2-inch joists were commonly used to support floors. The use of these joists would result in a plenum of approximately 7 inches between the underside of a floor and the upper surface of the ceiling of the level below. Conventional ceiling mounted light fixtures having heights between 6 and 7 inches could be installed within the 7-inch plenum without difficulty.

In recent years, there has been a trend toward reducing the height of the joists between floors in order to reduce building costs. The use of joists having dimensions of approximately 6 inches by 2 inches has been introduced into residential construction projects. Correspondingly, there has been a reduction in plenum heights, and it is more common to have plenum heights of approximately 6 inches in recent commercial and residential buildings. Reduced plenum heights may also be found in the context of renovations and building re-construction projects. If there has been a redesign of the interior of a building, other service access such as air conditioning ducting may be routed through the existing plenum, reducing the height available for ceiling mounted light fixtures. Conventional light fixtures having a stacked configuration of lamp housing, junction box and transformer cannot be installed in building projects where the plenum is less than the standard 7 inches.

It is desirable when installing ceiling mounted light fixtures to cut a single hole in the ceiling of approximately the size of the lamp housing, and to insert the light fixture into the plenum through this opening. Installation of this type avoids the need to cut and then reseal a larger installation opening once the light fixture is installed. A flanged external frame can be mounted to the installed light fixture to provide an attractive finished appearance for the finished ceiling mounted light.

It is an object of the present invention to provide a light fixture for a ceiling mounted light, which can be installed within plenum spaces that are of a height, which is less than the standard 7 inch plenum.

It is a further object of the present invention to provide a light fixture for a ceiling mounted light which can be installed within plenum spaces though a relatively small opening in the ceiling, of a size and shape which will ultimately contain the light housing.

SUMMARY OF THE INVENTION

In accordance with an aspect of the present invention there is provided a light fixture assembly having a lamp housing with a top, a lamp socket within the lamp housing, a power pack operatively connected to the lamp socket, and a means for supported attachment of the power pack to the lamp housing at a position substantially lateral to the lamp housing, and not extending substantially above a plane defined by the top of the lamp housing. The power pack comprises a junction box containing a transformer operatively connected to the lamp socket, and means for operative attachment of the power pack to an electrical source. The means for supported attachment of the power pack to the lamp housing permits flexion of the junction box relative to the lamp housing.

BRIEF DESCRIPTION OF THE DRAWINGS

The invention will be better understood and its advantages will become more apparent to those skilled in the art by reference to the following drawings, in conjunction with the accompanying specification, in which.

DETAILED DESCRIPTION OF EMBODIMENTS

Figure 1:
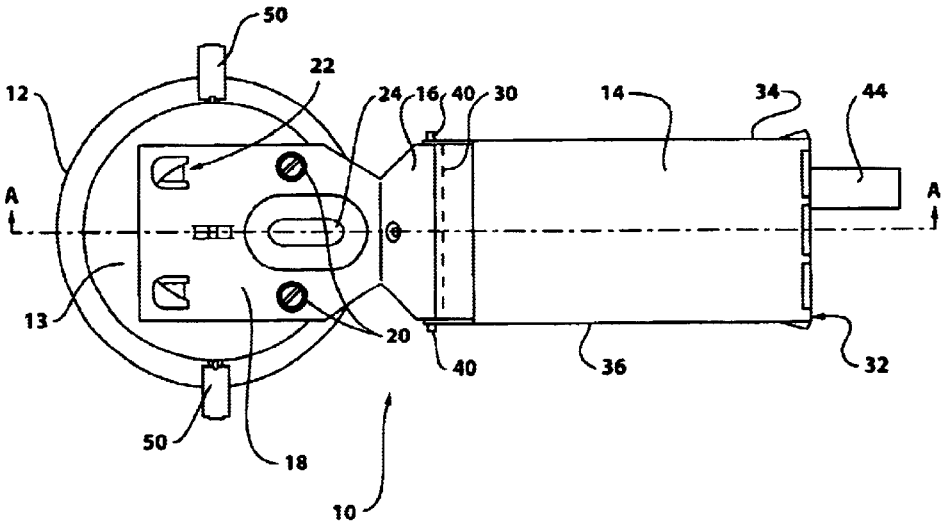
FIG. 1 is a top plan view of a light fixture according to the present invention.

Referring to FIGS. 1 through 4, there is shown a light fixture assembly generally identified by reference numeral 10. The light fixture assembly 10 comprises a lamp housing 12 having a top 13. There is provided a power pack shown by general reference numeral 15. The power pack 15, which will be functionally discussed in greater detail below, comprises a junction box 14. It will be understood that the functional elements of the power pack 15 are contained within the junction box 14. For simplicity, the description of the positioning and attachment of the power pack 15 relative to the lamp housing 12 will be discussed in terms of the structural features of the junction box 14.

Figure 4:
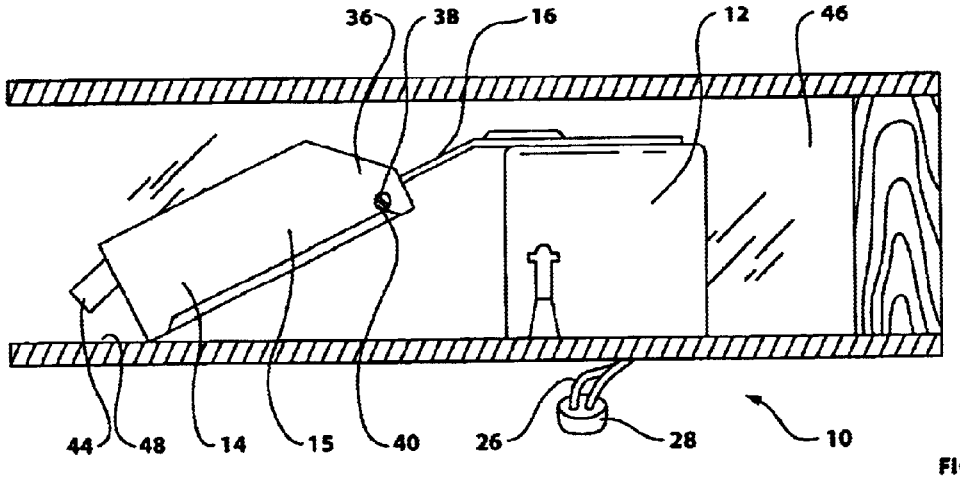

A means 16 is provided for supported attachment of the junction box 14 to the lamp housing 12 at a position substantially lateral to the lamp housing 12. The junction box 14, in supported attachment to the lamp housing 12, does not extend substantially above a plane defined by the top 13 of the lamp housing 12. As best illustrated in FIGS. 1 and 4, the positioning of the junction box 14 substantially laterally to and not extending substantially above the lamp housing 12 permits the light fixture assembly 10 to be installed in spaces which have little vertical clearance, such as in a shallow plenum 46 between floors of a recently constructed residential building.

Figure 2:
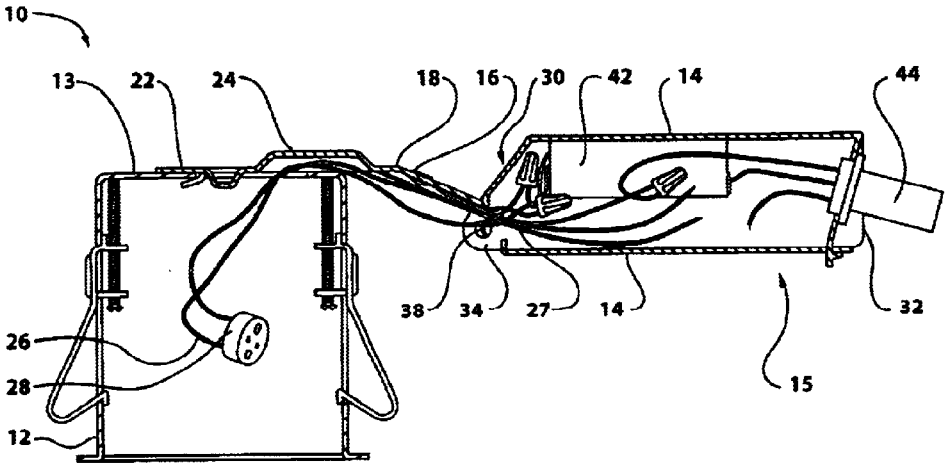
FIG. 2 is a cross section of the light fixture taken along line A—A of FIG. 1.

The means 16 for supported attachment of the junction box 14 to the lamp housing 12 preferably permits flexion of the junction box 14 relative to the lamp housing 12. As best seen in FIGS. 1 and 2, the attachment means 16 preferably comprises a channel top 18 which is mounted to the lamp housing 12 by fasteners such as screws 20 and locating tabs 22. The channel top 18 extends laterally from the top 13 of the lamp housing 12. The flexion is provided by means of a pivotal attachment of the channel top 18 to the junction box 14.

The junction box 14 comprises a first end wall 30 (shown in FIG. 1 as a dotted line) and second end wall 32. In the conventional manner the end walls 30 and 32 are attached to first side wall 34 and second side wall 36 and to a top and a bottom, so as to form the junction box 14. Each of the side walls 34, 36 extends beyond the first end wall 30, and defines a respective opening 38 sized and positioned to receive an engagement means 40 of the channel top. Together, the side walls 34, 36 and their respective openings 38 comprise a first pivot portion or receptor for pivotally receiving the engagement means 40 of the channel top 18. As best seen in FIGS. 1 and 4, the engagement means 40 of the channel top 18 provides a second pivot portion having a pair of pivot elements in the form of tabs 40 sized and positioned for pivotal retention within openings 38 of the first pivot portion or receptor.

In accordance with a preferred embodiment, the attachment means 16 is a channel top 18, which itself is rigid. The flexion is provided by a pivotal attachment of the channel top 18 to the junction box 14. It should be understood that other means of providing the desired flexion might be contemplated. For example, a pivot member may be placed within the length of the channel top, or a channel top of a flexible material could be substituted for the channel top of the present invention. Similarly, it would be understood by those skilled in the art that the use of tabs and openings is but one means of providing pivotal attachment of the junction box 14 to the lamp housing 12, and other means could be substituted within the spirit of the present invention.

The power pack 15 comprises the junction box 14 which contains a transformer 42 and is operatively connected to the lamp socket 28 within the lamp housing 12. Wiring 26 provides the operative connection to the lamp socket 28. Conventional wiring 27, including ground wires, is also shown within junction box 14 in FIG. 2 and provides the means for operative attachment of the power pack 15 to an electrical source. An embossment 24 is provided on the channel top 18 to permit clearance above the lamp housing 12 to facilitate the throughpassage of wires 26 for operative connection of the power pack 15 to the lamp socket 28. The power pack 15 may also contain a thermal cut out switch 44 operatively connected to the transformer 42 and to the means for operative attachment to a power source.

Figure 3:
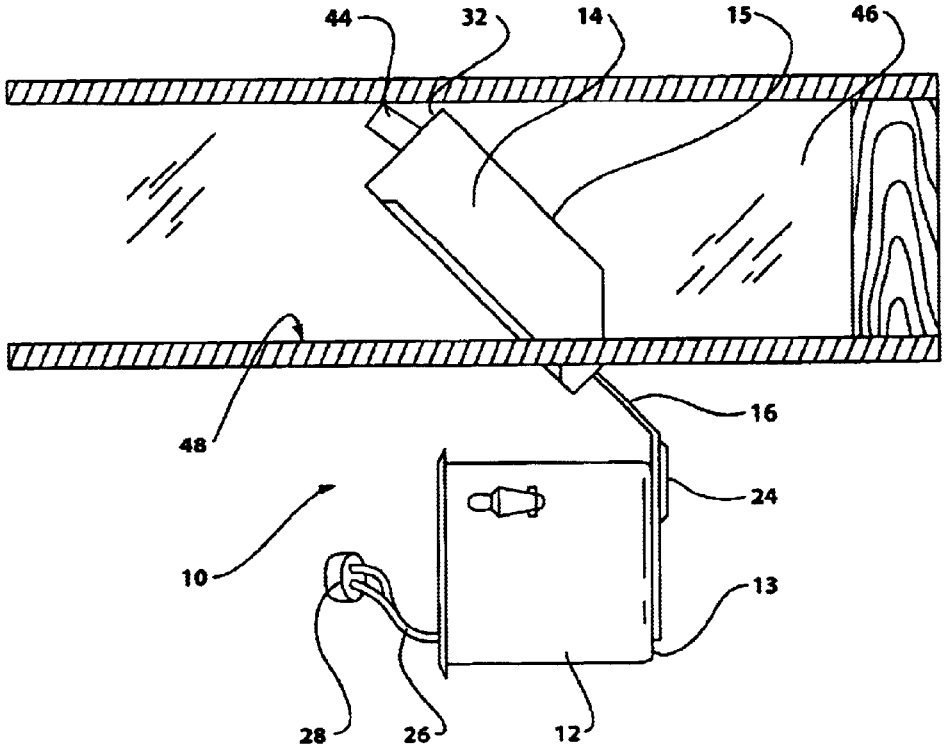
FIG. 3 is a perspective view of the light fixture shown partially installed within a notional plenum; and, FIG. 4 is a perspective view of the light fixture shown in an installed position within the notional plenum.

As best seen in FIGS. 3 and 4, the light fixture assembly is installed by first inserting the power pack 15 through an opening cut in the ceiling for access to the plenum 46. As the second end wall 32 of the junction box 14 and the thermal cut out switch 44 (if present) contact the upper limit of the plenum 46, the means 16 for supported attachment of the junction box 14 to the lamp housing 12 permits flexion of the junction box 14 relative to the lamp housing 12. In the preferred embodiment shown, this flexion results from the pivoting of the tabs 40 within respective openings 38 in the side walls 34, 36 of the junction box 14. Once the power pack 15 is entirely within the plenum 46 it will come to rest on the upper surface 48 of the ceiling. The surface 48 forms the lower limit of the plenum 46. The lamp housing 12 can then be inserted into the opening in the ceiling and secured in the installed position using biased locking tabs 50, or by other securing means. As shown in FIG. 4, once installed, the power pack 15 is positioned laterally to the lamp housing 12, and the power pack 15 does not extend substantially above the plane defined by the top 13 of the lamp housing 12. The preferred heights of the lamp housings for use in commercial and residential lighting applications are approximately 4 inches for standard lamp housings or 3¼ inches for ultra compact lamp housings. Accordingly, the present invention results in light fixture assemblies that do not exceed the respective lamp housing heights, and which can be readily installed in very shallow plenums.

In the preferred embodiment of the present invention, the light fixture assembly, the power pack and junction box are designed for optimal use of plenum space. It will be obvious to those skilled in the art that the structural and functional principles of the present invention need not be limited to very compact light fixtures, but could also be utilized in other lighting applications.

Also, other means of achieving flexion of the power pack and junction box relative to the lamp housing could be employed by those skilled in the art without deviating from the spirit of the present invention. Thus, it will be apparent that the scope of the present invention is limited only by the claims set out hereinbelow.

What is claimed is:

1. A light fixture assembly comprising:

a lamp housing having a top;

a lamp socket within the lamp housing;

a power pack operatively connected to the lamp socket; and, a means for supported attachment of the power pack to the lamp housing at a position substantially lateral to the lamp housing;

wherein the power pack does not extend substantially above a plane defined by the top of the lamp housing, the power pack comprising a junction box containing a transformer operatively connected to the lamp socket, and means for operative attachment of the power pack to an electrical source, wherein the means for supported attachment of the power pack to the lamp housing permits flexion of the junction box relative to the lamp housing, the means for supported attachment further comprising a channel top attached to the lamp housing and adapted for pivotal attachment to the junction box.

2. The light fixture assembly of claim 1, wherein the means for supported attachment includes a pair of pivot members, the junction box including a pair of openings, each of which to receive a corresponding pivot member.

3. The light fixture assembly of claim 2, wherein the junction box comprises first and second end walls, and first and second side walls, each of said side walls extending beyond the first end wall; and defining one of said openings.

4. The light fixture assembly of claim 3, wherein each of the pivot members includes a tab formed on the engagement means.

5. The light fixture assembly of claim 4, wherein the power pack further comprises a thermal cut out switch operatively connected to the transformer and to the means for operative attachment to a power source.

6. The light fixture assembly of claim 1 wherein the channel top further comprises an embossment to permit clearance of the channel top above the housing to facilitate the throughpassage of wires for operative connection of the power pack to the lamp socket.

7. A power pack for use with a light having a lamp socket within a lamp housing, the power pack comprising:

a junction box, a transformer contained within the junction box and adapted for operative connection to the lamp socket;

a means for operative attachment of the power pack to an electrical source; and, a means for supported attachment of the power pack to the lamp housing at a position substantially lateral to the lamp housing, wherein the means for supported attachment of the power pack to the lamp housing permits flexion of the junction box relative to the lamp housing, the means for supported attachment further comprising a channel top attached to the lamp housing and adapted for pivotal attachment to the junction box.

8. The power pack of claim 7, wherein the engagement means includes a pair of pivot portions, the junction box further comprising a pair of passages, each for receiving a corresponding pivot portion.

9. The power pack of claim 8, wherein the junction box comprises first and second end walls, and first and second side walls, each of said side walls extending beyond the first end wall, each of said passages being formed in a corresponding one of said side wall.

10. The power pack of claim 9, wherein the engagement means comprises a pair of tabs, each for pivotal retention within a corresponding one of said passages.

11. The power pack of claim 10, further comprising a thermal cut out switch operatively connected to the transformer and to the means for operative attachment to a power source.

12. A junction box for use with a lamp housing, said junction box comprising:

a first and a second end wall;

a first and a second side wall; and a means for supported attachment of the junction box to the lamp housing at a position substantially lateral to the lamp housing;

wherein the means for supported attachment of the junction box to the lamp housing permits flexion of the junction box relative to the lamp housing, wherein the means for supported attachment of the junction box to the lamp housing permits flexion of the junction box relative to the lamp housing.

13. The junction box of claim 12, wherein the means for the supported attachment includes a pair of pivot members, the junction box including a pair of passages, each for pivotally receiving a corresponding pivot member.

14. The junction box of claim 12, wherein each of the side walls extends beyond the first end wall, and each of the side walls defines a respective opening sized and positioned to receive the engagement means of the channel top, each side wall containing one of said passages.

15. The power pack of claim 13, wherein each of the pivot members includes a tab sized and positioned for pivotal retention within a corresponding passage.

16. A light fixture assembly comprising a lamp housing having a top, the lamp housing being arranged to receive a lamp socket therein, a power pack for powering the lamp socket; and pivot coupling means for pivotally coupling the power pack with the lamp housing at a position substantially laterally offset therefrom, the pivot coupling means operable to permit relative movement of the power pack relative to the housing during installation.

17. An assembly as defined in claim 16, the power pack further including a junction box and the pivot coupling means including a first pivot portion extending from the junction box and a second pivot portion extending from the lamp housing.

18. An assembly as defined in claim 17, the second pivot portion including a pair of pivot elements, the first pivot portion including a pair of openings, each of which to receive a corresponding pivot element.

19. An assembly of claim 18, the junction box including first and second end walls, and first and second side walls, each of said side walls extending beyond the first end wall and defining one of said openings.

20. The light fixture assembly of claim 19, each of the pivot elements including a tab formed near one end of the second pivot member.

21. The light fixture assembly of claim 20, the power pack including a thermal cut out switch operatively connected to the transformer and to the means for operative attachment to a power source.

22. The light fixture assembly of claim 20, wherein the second pivot portion is attachable to the top and includes a raised section which is spaced relative to the housing top to form there between a passage for wiring between the power pack and the lamp socket.

* * * * *